US010797450B2

(12) United States Patent
Chen et al.

(10) Patent No.: US 10,797,450 B2
(45) Date of Patent: Oct. 6, 2020

(54) ELECTRICAL CONNECTOR WITH UNITARY METALLIC SHELL HAVING OUTER PART AND INNER PART WITH TRANSITIONAL REGION THEREBETWEEN

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventors: De-Jin Chen, ShenZhen (CN); Xing-Liang Liu, Shenzhen (CN)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/391,340

(22) Filed: Apr. 23, 2019

(65) Prior Publication Data

US 2019/0326715 A1 Oct. 24, 2019

(30) Foreign Application Priority Data

Apr. 23, 2018 (CN) ..... 2018 1 0367602

(51) Int. Cl.
*H01R 13/6581* (2011.01)
*H01R 24/60* (2011.01)

(52) U.S. Cl.
CPC ..... *H01R 24/60* (2013.01); *H01R 13/6581* (2013.01)

(58) Field of Classification Search
CPC .. H01R 24/60; H01R 13/6581; H01R 13/658; H01R 13/6582; H01R 13/502; H01R 13/516; H01R 13/627; H01R 12/71
See application file for complete search history.

(56) References Cited

U.S. PATENT DOCUMENTS 6,241,556 B1 6/2001 Chih
6,267,624 B1 * 7/2001 Wu ..... H01R 13/658 439/607.35
6,375,498 B1 4/2002 Yu et al.
(Continued)

FOREIGN PATENT DOCUMENTS

TW M320221 10/2007

*Primary Examiner* — Edwin A. Leon
*Assistant Examiner* — Milagros Jeancharles
(74) *Attorney, Agent, or Firm* — Wei Te Chung; Ming Chieh Chang

(57) ABSTRACT

An electrical connector with an insulative housing, a plurality of contacts retained in the housing, and a metallic shell secured to the housing. The housing includes opposite first wall and second wall and a pair of side walls to generally commonly a mating slot communicating with an exterior via a mating opening. The shell includes opposite first plate and second plate and opposite side plates to commonly form a receiving cavity above the mating opening. The opposite side plates further include a pair of downwardly extending securing sections retained inside of the housing. The opposite side plates further include a pair of oblique transitional sections respectively located at roots of the pair of securing sections and in the receiving cavity and proximate to the mating opening for guiding consideration.

20 Claims, 6 Drawing Sheets

(56) References Cited

U.S. PATENT DOCUMENTS

| | | | | |
|---|---|---|---|---|
| 6,379,186 | B1 * | 4/2002 | Shi | H01R 13/658 439/607.36 |
| 6,676,449 | B2 * | 1/2004 | Ji | H01R 13/6582 439/607.35 |
| 6,918,777 | B2 * | 7/2005 | Fan | H01R 12/716 439/135 |
| 7,108,554 | B2 * | 9/2006 | Huang | H01R 23/6873 439/607.01 |
| 7,331,822 | B2 * | 2/2008 | Chen n | H01R 23/6873 439/607.01 |
| 7,445,502 | B2 * | 11/2008 | Zhang | H01R 13/658 439/607.01 |
| 7,445,504 | B1 * | 11/2008 | Zhang | H01R 13/6594 439/607.01 |
| 7,967,639 | B1 * | 6/2011 | Huang | H01R 13/6594 439/607.35 |
| 7,997,922 | B2 * | 8/2011 | Dawiedczyk | H01R 13/6275 439/357 |
| 8,834,206 | B2 * | 9/2014 | Tao | H01R 13/6581 439/607.19 |
| 9,461,378 | B1 * | 10/2016 | Chen | H01R 12/707 |
| 9,742,132 | B1 | 8/2017 | Hsueh | |
| 10,062,989 | B2 * | 8/2018 | Little | H01R 13/6582 |
| 10,096,949 | B2 * | 10/2018 | Zhang | H01R 12/707 |
| 10,312,639 | B2 * | 6/2019 | Chen | H01R 12/707 |
| 10,381,779 | B2 * | 8/2019 | Zhou | H01R 12/79 |
| 10,439,309 | B2 * | 10/2019 | Ju | H01R 13/113 |
| 2004/0043659 | A1 * | 3/2004 | Lai | H01R 23/6873 439/607.31 |

* cited by examiner

ELECTRICAL CONNECTOR WITH UNITARY METALLIC SHELL HAVING OUTER PART AND INNER PART WITH TRANSITIONAL REGION THEREBETWEEN

BACKGROUND OF THE INVENTION

1. Field of the Invention

The present invention relates generally to an electrical connector, and more particularly to an electrical connector with a unitary metallic shell having an outer part and an inner part with a guiding transitional region therebetween.

2. Description of Related Arts

China Patent No. CN 205693075 issued on Nov. 16, 2016, disclosed an electrical connector equipped with an outer metallic shell wherein the shell forms a pair of inward protrusions around the mating opening of the housing for guiding the side edges of mating tongue of the inserted plug connector. Anyhow, on one hand, the side edges of the inserted mating tongue of the plug connector are further desired to be guided in the mating slot of the receptacle connector rather than only outside of the mating slot. On the other hand, the securement between the shell and the housing is formed on an exterior surface of the housing, thus increasing the dimension of the whole connector disadvantageously.

An improved electrical connector is desired.

SUMMARY OF THE INVENTION

An object of the present invention is to provide an electrical connector with an insulative housing, a plurality of contacts retained in the housing, and a metallic shell secured to the housing. The housing includes opposite first wall and second wall and a pair of side walls to generally commonly a mating slot communicating with an exterior via a mating opening. A plurality of passageways are formed in the first wall and the second wall to communicate with the mating slot. The contact includes a contacting section extending into the mating slot and a tail exposed outside of the housing. The shell includes opposite first plate and second plate and opposite side plates to commonly form a receiving cavity above the mating opening. The housing forms a pair of insertion grooves communicatively located by two opposite ends of the mating slot. The opposite side plates further include a pair of downwardly extending securing sections retained in the corresponding insertion grooves, respectively, so as to cooperate with the opposite first wall and second wall to precisely form the mating slot thereamong. The opposite side plates further include a pair of oblique transitional sections respectively located at roots of the pair of securing sections and in the receiving cavity and proximate to the mating opening for guiding consideration.

DETAILED DESCRIPTION OF THE PREFERRED EMBODIMENT

Figure 1:
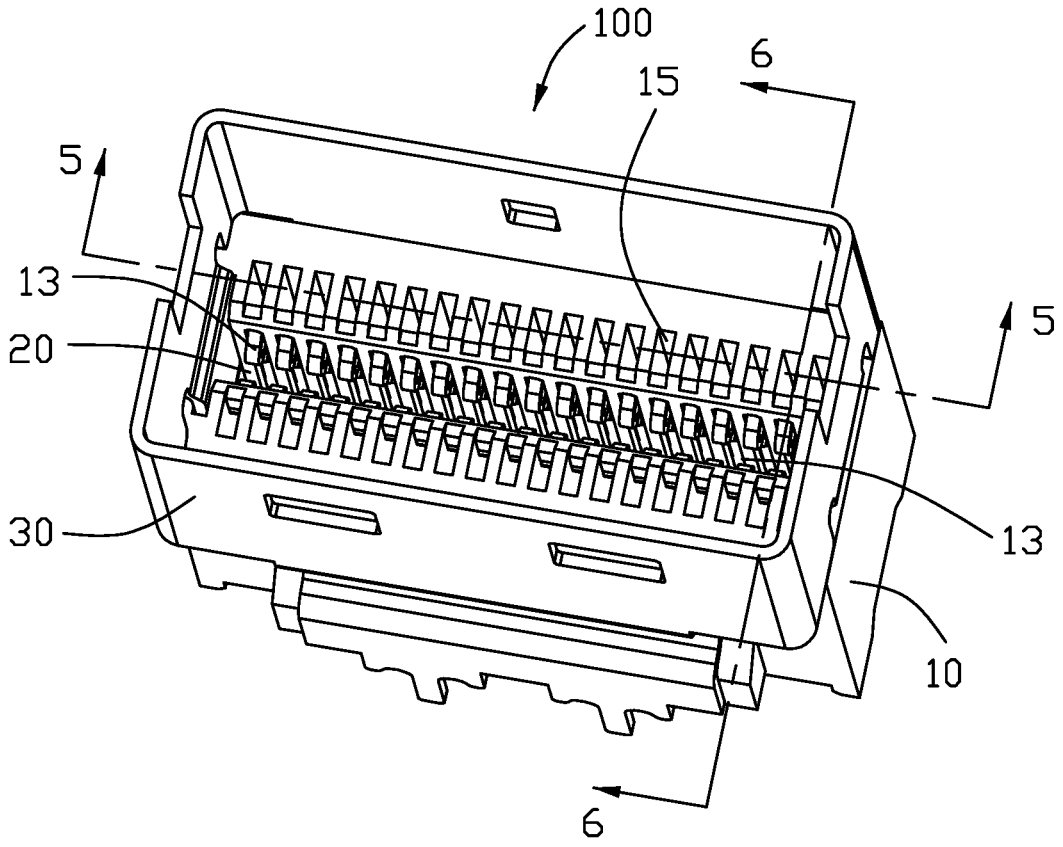
FIG. 1 is a perspective view of an electrical connector in accordance with the present invention.
Figure 2:
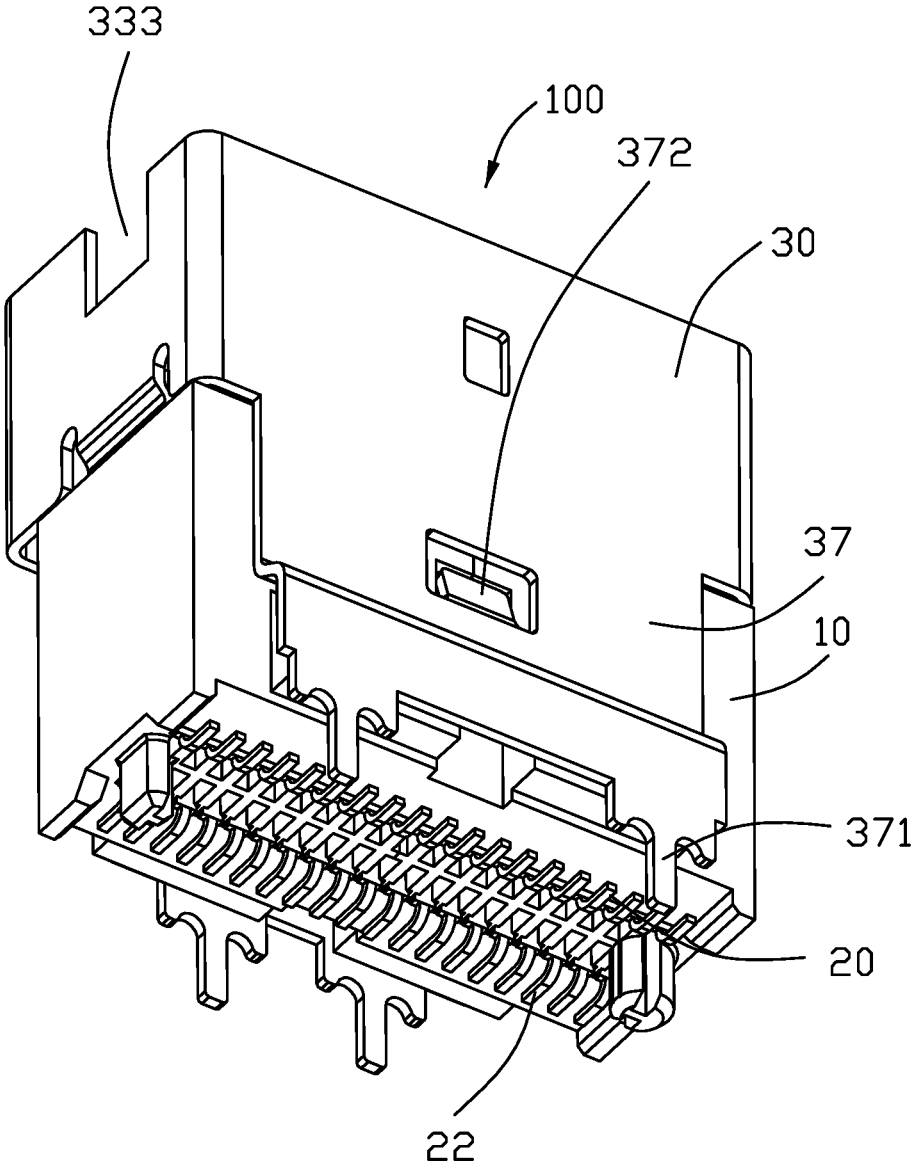
FIG. 2 is another perspective view of the electrical connector of FIG. 1.
Figure 3:
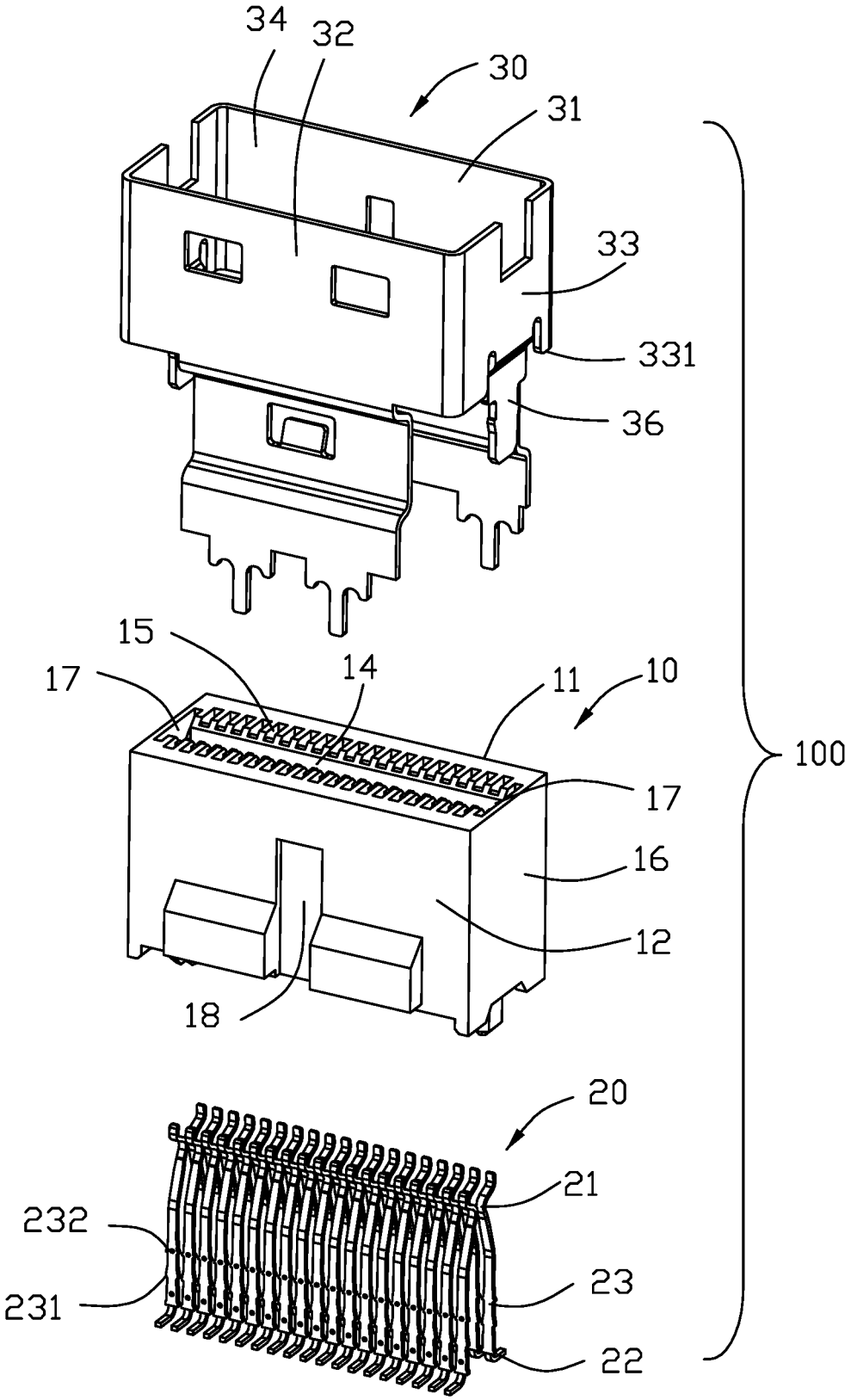
FIG. 3 is an exploded perspective view of the electrical connector of FIG. 1.
Figure 4:
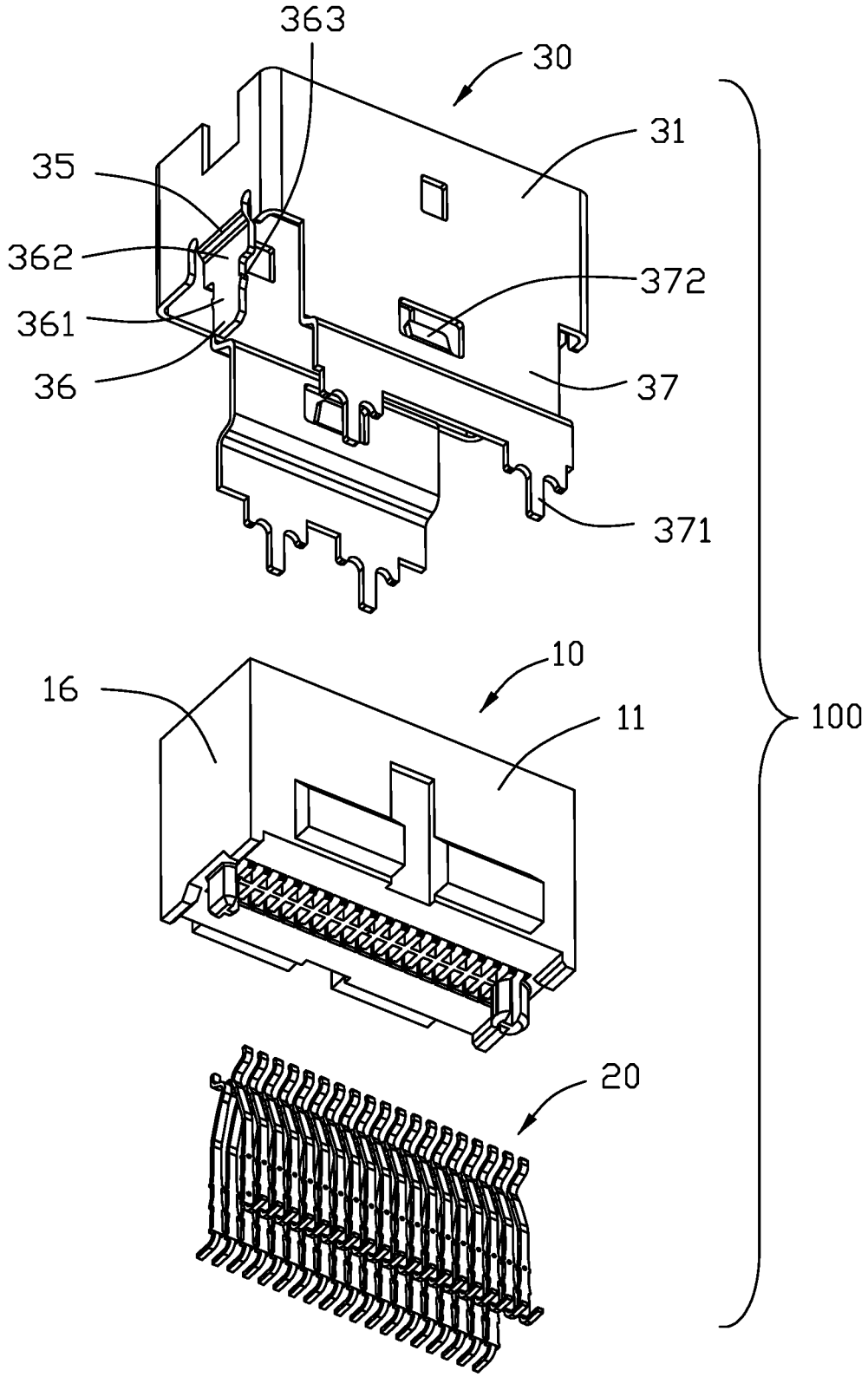
FIG. 4 is another exploded perspective view of the electrical connector of FIG. 3.

Referring to FIG. 1-6, an electrical connector 100 for mounting upon a printed circuit board (not shown) in a vertical direction as an upstanding type, includes an insulative housing 10, a plurality of contacts 20 retained in the housing 10, and a metallic shielding shell secured to the housing 10.

The insulative housing 10 includes a first wall 11 and a second wall 12 opposite to each other with a mating slot 13 therebetween in a transverse/first direction. A mating opening 14 is formed in the upper surface of the housing 10 to communicate the mating slot with an exterior upwardly in a vertical/third direction. A plurality of passageways 15 are formed in the first wall 11 and the second wall 12. Each passageway 15 extends upwardly through the upper surface of the housing. A pair of side walls 16 are linked at two opposite ends of the first wall 11 and the second wall 12 along a longitudinal/second direction perpendicular to the transverse direction. A pair of insertion grooves 17 are formed in interior surfaces of the pair of side walls 16, communicatively facing toward the mating slot 13 oppositely. The pair of insertion grooves 17 extend upwardly through upper surfaces of the housing 10 and are dimensioned larger than the mating slot 13 in the transverse direction.

The contact 20 received within the corresponding passageway 15, includes a contacting section 21 extending into the mating slot 13, a tail section 22 exposed outside of the housing 10, and a retaining section 23 linked between the contacting section 21 and the tail section 22. The retaining section 23 includes barbs 231 on the side edge and embossments 232 on the planar face for interference within the passageway 15 in the three dimensional way. The The metallic shell 30 is downwardly assembled to the housing 10 and includes a first plate 31, a second plate 32 opposite to each other in the transverse direction, and a pair of side plates 33 linked between the first plate 31 and the second plate 32 in the transverse direction so as to commonly form thereamong a receiving cavity 34 located above the upper surface of the housing 10. Notably, in other embodiments, only one of the first plate 31 and the second plate 32 exists as long as the pair of side plates 33 are only linked to such one of the first plate 31 and the second plate 32. In other words, the shell 30 forms a U-shaped structure instead of a frame structure. The pair of side plates 33 form respectively a pair of notches 333 in upper regions, and a pair of oblique transitional sections 35 and a pair of securing sections 36 extending downwardly therefrom in lower regions. The oblique transitional section 35 is located at a bottom region of the receiving cavity 34 proximate to the mating opening 14. Understandably, the oblique transitional section 35 is used to guide downwardly insertion of the mating tongue of the complementary plug (not shown) into the mating slot 13.

Figure 5:
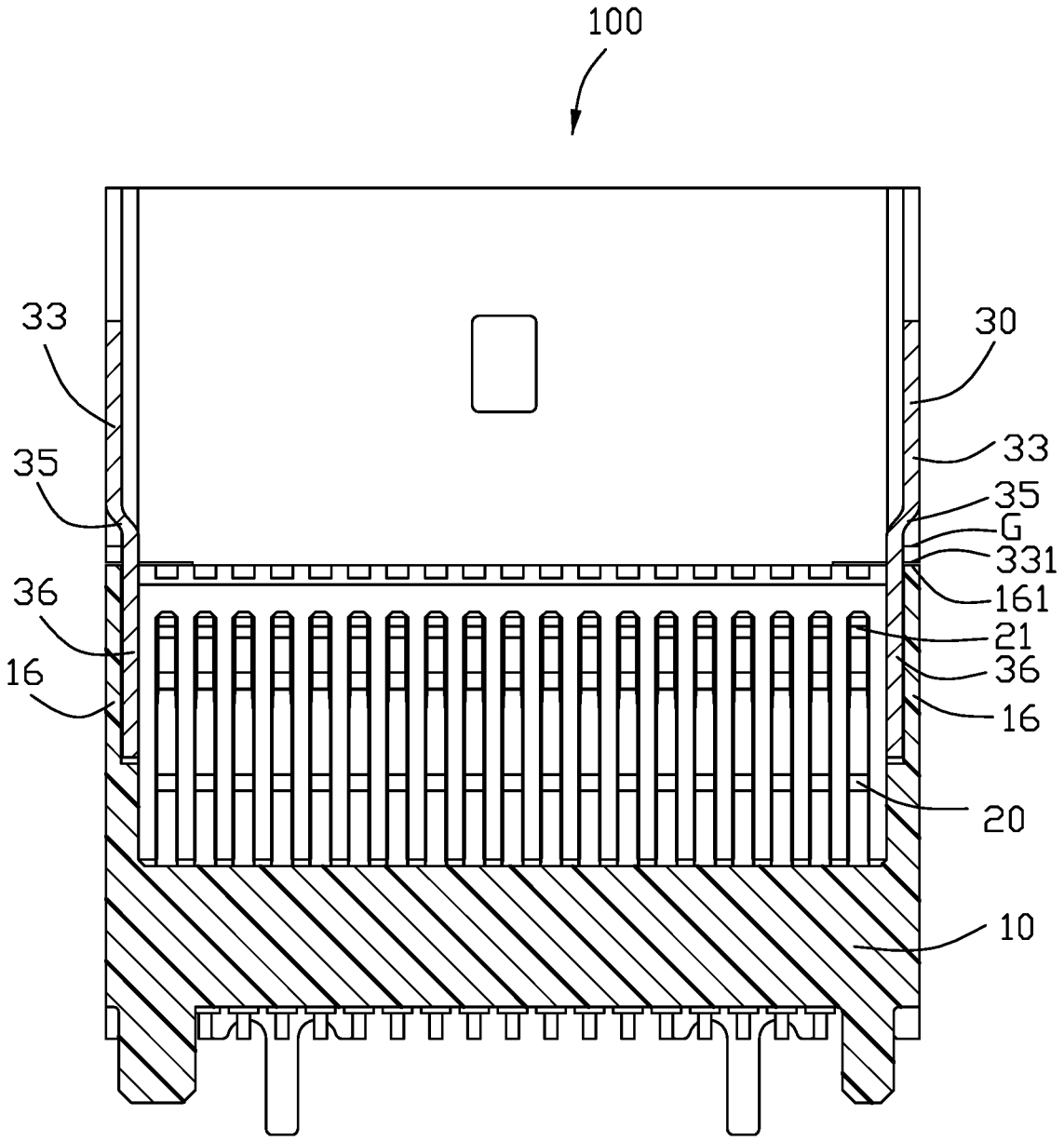
FIG. 5 is a cross-sectional view of the electrical connector of FIG. 1 along line 5-5.
Figure 6:
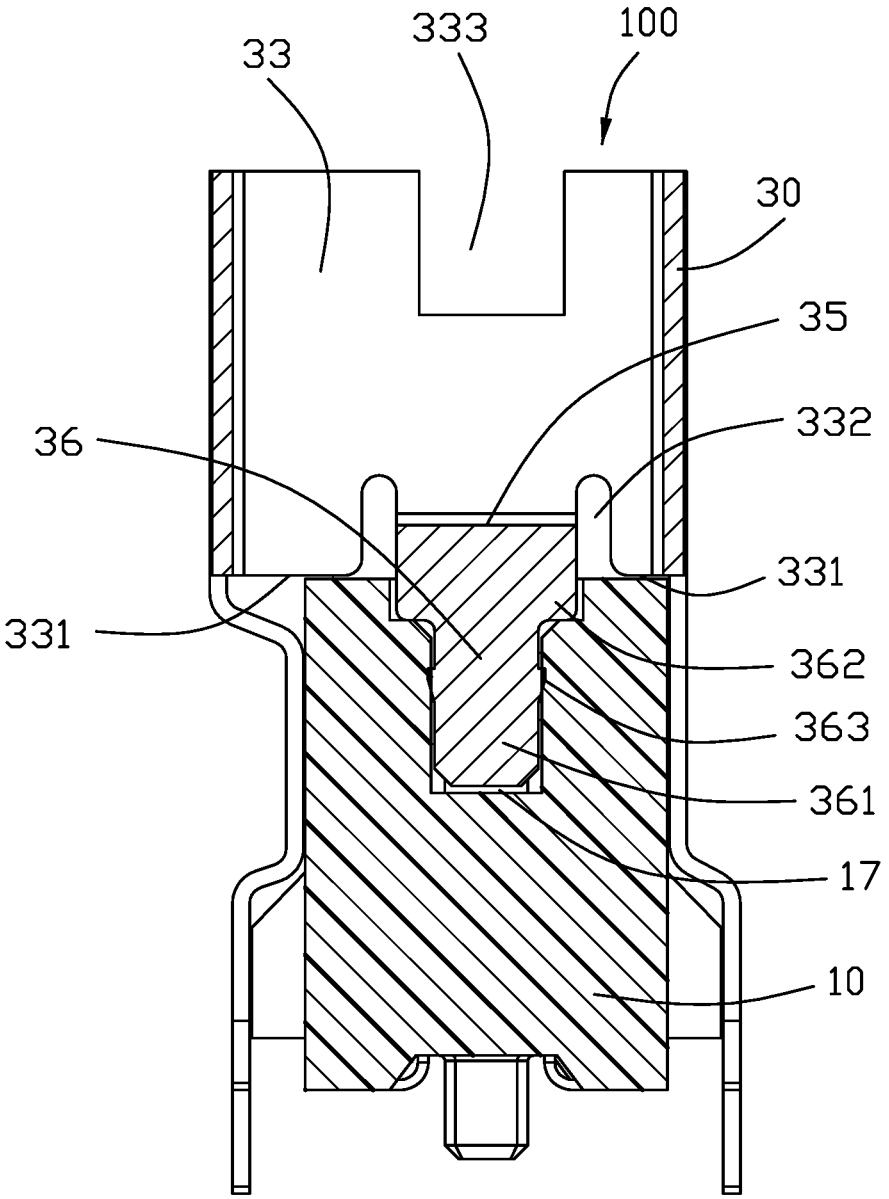
FIG. 6 is another cross-sectional view of the electrical connector of FIG. 1 along line 6-6.

The securing sections 36 extending downwardly from the corresponding oblique transitional sections 35, respectively, are received within the corresponding insertion grooves 17, and cooperate with the first wall 11 and the second wall 12 to commonly precisely form the mating slot 13. Understandably, the securing sections 36 not only secure the shell 30 to the housing 10, but also efficiently protectively confront the mating tongue of the inserted plug (not shown), thus avoiding improper wearing between the side walls 16 and the side edges of the mating tongue of the inserted plug (not shown). The bottom end 331 of each side plate 33 abuts against the upper surface of the housing 10 so as to stabilize the shell 30 upon the housing 10 in addition to the engagement between the securing sections 36 within the insertion grooves 17. Each side plate 33 further includes a pair of notches 332 by two sides of the oblique transitional section 35 for facilitating manufacturability of the transitional section 35. Understandably, after assembled, the bottom end 331 downwardly abuts against the upper surface of the side wall 16 of the housing 10 (FIG. 6) while the oblique transitional section 35, which is essentially located slightly above the bottom end 331 in the vertical direction, is slightly above the upper surface with a gap G therebeween (FIG. 5). Therefore, there is less possibility to have the oblique transitional section 35 hit by the upper surface of the corresponding side wall 16 during assembling, thus assuring no improper deformation occurs on the oblique transitional section 35. The width of the securing section 36 is larger than that of the mating slot 13 along the transverse direction. The distance between the pair of side plates 33 is larger than that between the pair of securing sections 35 in the longitudinal direction. The width of the receiving cavity 34 is larger than that of the mating slot 13 in the transverse direction. Understandably, the vertical dimension of the receiving cavity 34 should be larger than that of the mating slot 13 so as to guide the mating tongue of the inserted plug (not shown) into the mating slot 13 by engagement of the holding section of the inserted plug (not show) first confront the upper portion of the shell 30 before the mating tongue of the inserted plug (not shown) enters the mating slot 13.

The securing section 36 includes the securing leg 361 and the connection section 362 linked to the oblique transitional section 35. The securing leg 361 is equipped with barbs 363 for interference within the insertion groove 17. The width of the securing leg 361 is smaller than that of the connection section 362 so as to form a T-shaped configuration of the whole securing section 36. An upper end portion of the connection section 362 is slightly located above the upper surface of the side wall 16 so as to assure sufficient protection during mating. The first plate 31 and the second plate 32 further include downwardly extending plates 37 to respectively cover the first wall 11 and the second wall 12. Each downwardly extending plate 37 further includes the mounting legs 371 for mounting the connector 100 upon the printed circuit board (not shown), and a latching section 372 to be fastened into the fixing slot 18 of the corresponding first wall 11 or second wall 12. Notably, after assembled, the shell 30 is retained to the housing 10 by engagement between the bottom end 331 and the upper surface of the side wall 16, and that between the latching section 372 within the fixing slot 18 and that between the securing section 36 within the insertion groove 17.

In the invention, the securing sections 36 replace the side wall 16 to confront the mating slot 13 and the mating tongue of the inserted plug (not shown).

The invention has the following advantages:

Firstly, the securing sections 36 are located inside the housing 10 without occupying additional external space, and may efficiently protect the mating tongue of the inserted plug (not shown).

Secondly, the bottom end 331 of the side plate 31 abuts against the upper surface of the side wall 16, thus avoiding excessive movement during assembling between the housing 10 and the shell 30.

Thirdly, the notches 332 are formed by two sides of the oblique transitional section 35, thus facilitating forming the oblique transitional section 35.

Fourthly, the oblique transitional section 35 is spaced from an upper surface of the corresponding side wall 16, thus avoiding improper deformation of the oblique transitional section 35 during assembling the shell 30 to the housing 10.

Fifthly, the securing section 36 performs dual functions of both securing the shell 30 to the housing 10 and cooperating with the associated oblique transitional section 35 for guiding and protecting the mating tongue of the inserted plug (not shown).

In brief, the securing section 36 and the associated oblique transitional section 35 commonly form an assuring device performing multiple functions including securing, protecting and guiding not only during the mating procedure but also after the mating condition. Generally speaking, the whole shell 30 essentially includes an outer part including the first plate 31, the second plate 32, the pair of side plates 33, the pair of downwardly extending walls 37, and an inner part including the pair of securing sections 36 and the pair of oblique transitional sections 35 associated therewith wherein the outer part provides the receiving cavity 34 for receiving the relatively large holding portion of the inserted plug (not shown) and provides securing between the housing 10 and the shell 30, while the inner part cooperates with the housing 10 to form the mating slot 13 for protectively receiving the relatively small mating tongue of the inserted plug (not shown) and provides the securing between the housing 10 and the shell 30. Understandably, as shown in FIG. 5, the bottom end 331 of the side plate 33 downwardly abuts against the upper surface 161 of the side wall 16 securely while the oblique transitional section 35 is intentionally space from the upper surface of the corresponding side wall 16 for avoiding any deformation during assembling so as to expose the upper surface 161 with a gap G therebetween without intimate shielding or protection.

What is claimed is:

1. An electrical connector comprising:

an insulative housing including first and second walls opposite to each other in a transverse direction, and a pair of side walls linked between the first wall and the second wall and opposite to each other in a longitudinal direction perpendicular to the transverse direction;

a mating slot formed among the first wall, the second wall and the pair of side walls, and upwardly communicating with an exterior, in a vertical direction perpendicular to both the transverse direction and the longitudinal direction, via a mating opening formed in an upper surface of the housing;

a plurality of contacts retained in the first wall and the second wall, each of said contacts including a contacting section extending into the mating slot; and a metallic shell secured to the housing and including first and second plates opposite to each other in the transverse direction, and a pair of side plates linked between the first plate and the second plate and opposite to each other in the longitudinal direction, a receiving cavity formed among the first plate, the second plate and the pair of side plates and located above the housing in the vertical direction away from the mating slot; wherein the metallic shell further includes a pair of assuring devices unitarily extending from the corresponding side plates, respectively, and each of said assuring devices includes an oblique transitional section spaced above an upper surface of the corresponding side wall, and a securing section downwardly extending into an insertion groove in an inner surface of the corresponding side wall and directly communicatively facing the mating slot in the longitudinal direction.

2. The electrical connector as claimed in claim 1, wherein the assuring device essentially extends downwardly from a bottom end region of the corresponding side plate.

3. The electrical connector as claimed in claim 1, wherein each of said side plates includes a bottom end downwardly abutting against the upper surface of the corresponding side wall.

4. The electrical connector as claimed in claim 1, wherein a width of the insertion groove is larger than that of the mating slot in the transverse direction.

5. The electrical connector as claimed in claim 1, wherein a distance between the pair of securing sections is same with a dimension of the mating slot in the longitudinal direction.

6. The electrical connector as claimed in claim 1, wherein the securing sections is equipped with barbs.

7. The electrical connector as claimed in claim 1, wherein the securing section is of a T-shaped structure.

8. The electrical connector as claimed in claim 7, wherein an upper portion of the securing section is located above the upper surface of the corresponding side wall.

9. The electrical connector as claimed in claim 1, wherein in each side plate, a pair of notches are located by and proximate to two sides of the assuring device for facilitating manufacturing said assuring device.

10. The electrical connector as claimed in claim 1, wherein the securing section is hidden from the exterior in both the transverse direction and the longitudinal direction by the housing.

11. An electrical connector comprising:

an insulative housing including first and second walls opposite to each other in a first direction, and a pair of side walls linked between the first wall and the second wall and opposite to each other in a second direction perpendicular to the first direction;

a mating slot formed among the first wall, the second wall and the pair of side walls, and communicating with an exterior, in a third direction perpendicular to both the first direction and the second direction, via a mating opening formed in a surface of the housing;

a plurality of contacts retained in the first wall and the second wall, each of said contacts including a contacting section extending into the mating slot; and a metallic shell secured to the housing and including an outer part and an inner part, the outer part including first and second plates opposite to each other in the first direction, and a pair of side plates linked between the first plate and the second plate and opposite to each other in the second direction, a receiving cavity formed among the first plate, the second plate and the pair of side plates and located outside of the housing opposite to the mating slot;

the inner part including a pair of securing sections retained in interior surfaces of the corresponding side walls, respectively; wherein each securing section is linked with the corresponding side plate via an oblique transitional section which is spaced from the surface of the housing in the third direction; wherein each securing section is offset from the corresponding side plate in the second direction; wherein each securing section directly communicates with and is exposed to the mating slot in the second direction.

12. The electrical connector as claimed in claim 11, wherein a pair of notches are formed in the corresponding side plate located by two sides and proximate to the corresponding oblique transitional section in the first direction.

13. The electrical connector as claimed in claim 11, wherein the securing section forms a T-shaped structure.

14. The electrical connector as claimed in claim 11, wherein an upper portion of the securing section is linked to the corresponding oblique transitional section and spaced from the surface in the third direction.

15. The electrical connector as claimed in claim 11, wherein an end of each side plate abuts against the surface of the housing in the third direction.

16. The electrical connector as claimed in claim 11, wherein a distance between the pair of securing sections is equal to a dimension of the mating slot in the second direction.

17. The electrical connector as claimed in claim 11, wherein the securing section is hidden from the exterior in both the first direction and the second direction by the housing.

18. An electrical connector comprising:

an insulative housing including first and second walls opposite to each other in a first direction, and a pair of side walls linked between the first wall and the second wall and opposite to each other in a second direction perpendicular to the first direction;

a mating slot formed among the first wall, the second wall and the pair of side walls, and communicating with an exterior, in a third direction perpendicular to both the first direction and the second direction, via a mating opening formed in a surface of the housing;

a plurality of contacts retained in the first wall and the second wall, each of said contacts including a contacting section extending into the mating slot; and a metallic shell secured to the housing and including an outer part and an inner part, the outer part including at least one plate extending along the second direction, and a pair of side plates opposite to each other and linked at two opposite ends of said at least one plate in the second direction, a receiving cavity formed among the at least one plate and the pair of side plates and located outside of the housing opposite to the mating slot;

the inner part including a pair of securing sections retained in interior surfaces of the corresponding side walls, respectively; wherein each securing section is linked with the corresponding side plate via an oblique transitional section which is spaced from the surface of the housing in the third direction; wherein each securing section is offset from the corresponding side plate in the second direction; wherein each securing section directly communicates with and is exposed to the mating slot in the second direction.

19. The electrical connector as claimed in claim 18, wherein an upper portion of the securing section is linked to the corresponding oblique transitional section and spaced from the surface in the third direction.

20. The electrical connector as claimed in claim 18, wherein an end of each side plate abuts against the surface of the housing in the third direction.

* * * * *